US010371410B1

(12) United States Patent
Gaudet, Jr. et al.

(10) Patent No.: US 10,371,410 B1
(45) Date of Patent: Aug. 6, 2019

(54) VENTILATION SYSTEM FOR STORAGE COVERS AND METHOD OF USE

(71) Applicant: J&M INDUSTRIES, INC., Ponchatoula, LA (US)

(72) Inventors: Donald Gaudet, Jr., Ponchatoula, LA (US); Aaron Gummer, New Orleans, LA (US)

(73) Assignee: J&M Industries, Inc., Pontchatoula, LA (US)

( * ) Notice: Subject to any disclaimer, the term of this patent is extended or adjusted under 35 U.S.C. 154(b) by 65 days.

(21) Appl. No.: 15/814,845

(22) Filed: Nov. 16, 2017

Related U.S. Application Data

(63) Continuation of application No. 14/685,322, filed on Apr. 13, 2015, now Pat. No. 9,851,122, which is a continuation-in-part of application No. 14/449,765, filed on Aug. 1, 2014, now abandoned.

(51) Int. Cl.
*F24F 13/08* (2006.01)
*F24F 13/10* (2006.01)
*F24F 13/14* (2006.01)

(52) U.S. Cl.
CPC ..... *F24F 13/084* (2013.01); *F24F 13/10* (2013.01); *F24F 13/14* (2013.01)

(58) Field of Classification Search
CPC ..... F24F 13/084; F24F 13/10; F24F 13/14
USPC ..... 454/358
See application file for complete search history.

(56) References Cited

U.S. PATENT DOCUMENTS 2,895,400 A * 7/1959 Topf ..... A01F 25/14 34/402
3,380,370 A * 4/1968 Mack ..... E04H 15/14 135/93
4,915,022 A * 4/1990 Lynch ..... A01G 9/242 454/364
5,960,560 A * 10/1999 Stoll ..... F26B 3/286 34/212
6,021,794 A * 2/2000 Guerra ..... E04H 15/001 135/121
6,189,228 B1 * 2/2001 Schuette ..... D06F 58/20 34/235
7,340,845 B2 * 3/2008 Kneebone ..... B01D 1/30 210/137
8,726,534 B2 * 5/2014 Chappell ..... F26B 9/003 206/315.1
9,574,369 B2 * 2/2017 Gaudet, Jr. ..... B65G 3/02
9,851,122 B2 * 12/2017 Gaudet, Jr. ..... F24F 13/084
9,890,550 B2 * 2/2018 Gaudet, Jr. ..... B65G 3/02
2005/0066591 A1 * 3/2005 Worley ..... E04H 15/16 52/138
2010/0122981 A1 * 5/2010 Sims ..... F16K 27/067 220/1.6
2016/0029566 A1 * 2/2016 Gaudet ..... E02D 3/00 34/233

FOREIGN PATENT DOCUMENTS

CA 2863627 C * 2/2018 ..... B65G 3/02
WO WO-2013116718 A1 * 8/2013 ..... B65B 3/02

* cited by examiner

*Primary Examiner* — Stephen M Gravini

(74) *Attorney, Agent, or Firm* — Emily L. Gordy; Carver, Darden, Koretzky, Tessier, Finn, Blossman & Areaux, LLC

(57) ABSTRACT

The present invention relates to a reliable, efficient, and low cost ventilation system for storage covers that improves the distribution of air flow and improves aeration of the particulate material and the method of installing the same.

7 Claims, 22 Drawing Sheets

VENTILATION SYSTEM FOR STORAGE COVERS AND METHOD OF USE

CONTINUATION APPLICATION

This application is a continuation from U.S. Non-Provisional patent application Ser. No. 14/685,322 to Donald Gaudet, Jr. and Aaron Gummer filed on Apr. 13, 2015 which is a continuation-in-part from U.S. Non-Provisional patent application Ser. No. 14/449,765 to Donald Gaudet, Jr. and Aaron Gummer filed on Aug. 1, 2014.

BACKGROUND OF THE INVENTION

Field of the Invention

The present invention relates to a novel system for ventilating particulate piles covered by storage covers.

General Background

Various types of storage covers, configured in various arrangements, have been developed for covering piles or mounds of material, such as silage (animal feed), salt, sand, calcium carbonate, grain, and the like from the effects of weather, sun, water intrusion and/or insect or rodent infestations while said material is in outside storage.

Storage covers exist in various shapes, sizes and configurations. In a first arrangement of storage covers, these storage covers consist of a fabric tarp wherein the perimeter of the fabric tarp is secured to a retaining wall extending around the perimeter of the fabric tarp. The retaining wall is often made of a perforated metal that allows air flow between the outside environment and the covered pile. At the center of the fabric tarp, and connected to the fabric tarp, exists a lifting ring. After the storage cover is deployed and attached to the lifting ring, the lifting ring is raised and the particulate material is deposited through the lifting ring and under the storage cover.

In an alternative arrangement, particulate material is first deposited within the retaining wall. After the particulate material is deposited, the fabric tarp is then deployed over the particulate material, and the perimeter of the fabric tarp is secured to the retaining wall. In contrast to the above described arrangement, the fabric tarp is deployed over the particulate material after the particulate material is piled, and thus does not utilize a lifting ring to deposit particulate material beneath the storage cover.

In yet another type of arrangement of storage covers, the storage covers consist of a fabric tarp covering a pile of particulate material wherein the perimeter of the fabric tarp lays approximately parallel to the ground, and does not utilize a retaining wall. In this arrangement, the fabric tarp is deployed over the particulate material after the particulate material is piled, and also does not utilize a lifting ring to deposit particulate material beneath the storage cover.

Particulate material covered by storage covers often suffer from the problems of mold growth, moisture migration, and insect or rodent infestation. Aeration of the particulate pile is a method of preventing and/or remedying these problems. Aeration requires a mechanical system that moves air through the particulate pile. A common aeration method in particulate piles covered by a storage cover is to use fans installed at the base of the particulate pile to create suction airflow underneath the storage cover. However, this method does not result in creation of air flow through the height of the pile and instead concentrates the air flow at the base of the pile.

In some aeration methods, aeration pipes are attached to aeration fans wherein the aeration pipes are placed at the base of the particulate pile and extend towards the center of the particulate pile. In some instances additional aeration pipes are also placed on top of the particulate material (and underneath the storage cover). However, even the use of these additional aeration pipes does not result in an adequate air flow throughout the height of the particulate pile. Thus, the problem of providing adequate distribution of aeration air to the particulate material of a pile continues to exist. The present invention provides a reliable, efficient, and low cost ventilation system for storage covers that improves the distribution of air flow and improves aeration of the particulate material.

SUMMARY OF THE PRESENT INVENTION

The present invention contemplates a vent comprising a vent body; a mesh layer removably attached to said vent body wherein said mesh layer is movable from an attached to a detached position and wherein when said mesh layer is in said attached position, said mesh layer at least partially covers said vent body; and a flap attached to said vent body wherein said flap is movable from an opened position to a closed position and wherein when said flap is in said closed position, said flap covers said mesh layer.

The present invention further contemplates a method for installing comprising the steps of providing a vent wherein said vent comprises: (i) a vent body wherein said vent body comprises a perimeter; (ii) a mesh layer removably attached to said vent body wherein said mesh layer is movable from an attached to a detached position and wherein when said mesh layer is in said attached position, said mesh layer at least partially covers said vent body; and (iii) a flap attached to said vent body wherein said flap is movable from an opened position to a closed position and wherein when said flap is in said closed position, said flap covers said mesh layer; providing a tarp body; placing said vent on top of said tarp body; attaching said perimeter of said vent body to said tarp body; moving said flap to at least a partially open position; moving said mesh layer to at least a partially detached position; removing a portion of said vent body to expose a portion of said tarp body; removing a portion of said exposed tarp body; and moving said mesh layer into said attached position.

The present invention further contemplates a kit for ventilating a storage cover comprising a vent wherein said vent comprises: (i) a vent body wherein said vent body comprises a perimeter; (ii) a mesh layer removably attached to said vent body wherein said mesh layer is movable from an attached to a detached position and wherein when said mesh layer is in said attached position, said mesh layer at least partially covers said vent body; and (iii) a flap attached to said vent body wherein said flap is movable from an opened position to a closed position and wherein when said flap is in said closed position, said flap covers said mesh layer; tape; and a cutting device.

BRIEF DESCRIPTION OF THE DRAWINGS

For a further understanding of the nature and objects of the present invention, reference should be had to the following descriptions taken in conjunction with the accompanying drawings in which like parts are given like reference numerals.

DETAILED DESCRIPTION

The Ventilation System

Figure 1:
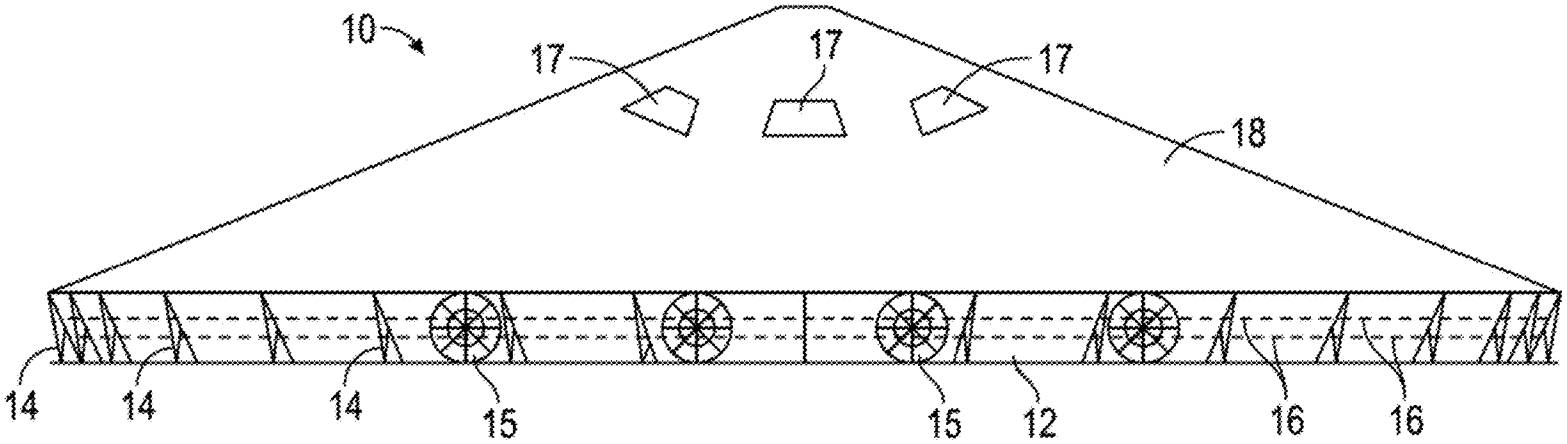
FIG. 1 shows a front view of a particulate pile surrounded by a retaining wall and covered by a storage cover having vents.
Figure 2:
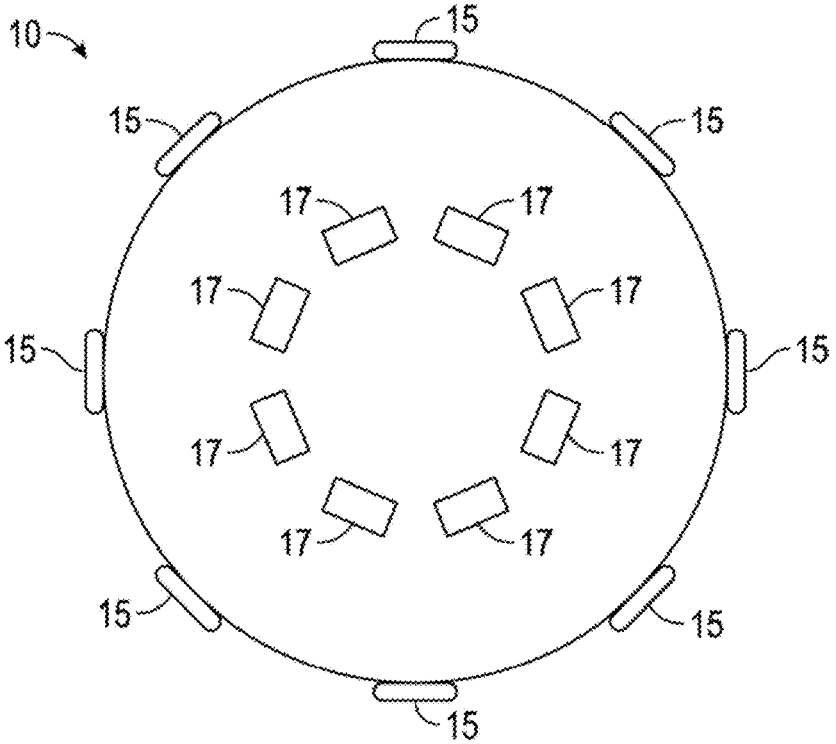
FIG. 2 shows a plan view of a particulate pile covered by a circular-shaped storage cover having vents.
Figure 4:
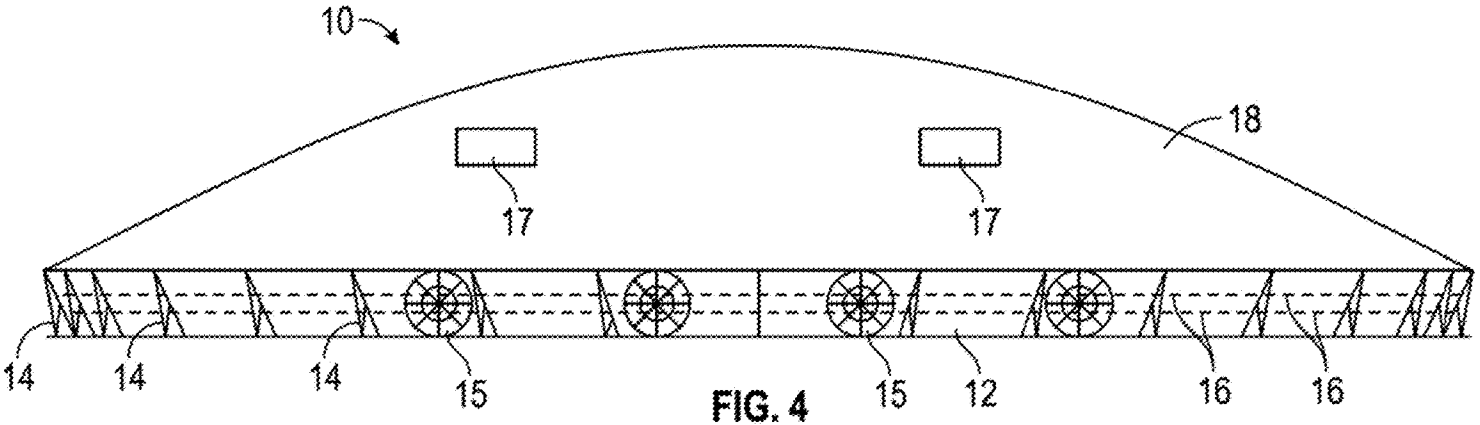
FIG. 4 shows a front view of a particulate pile surrounded by a retaining wall and covered by an oval-shaped storage cover having vents.
Figure 5:
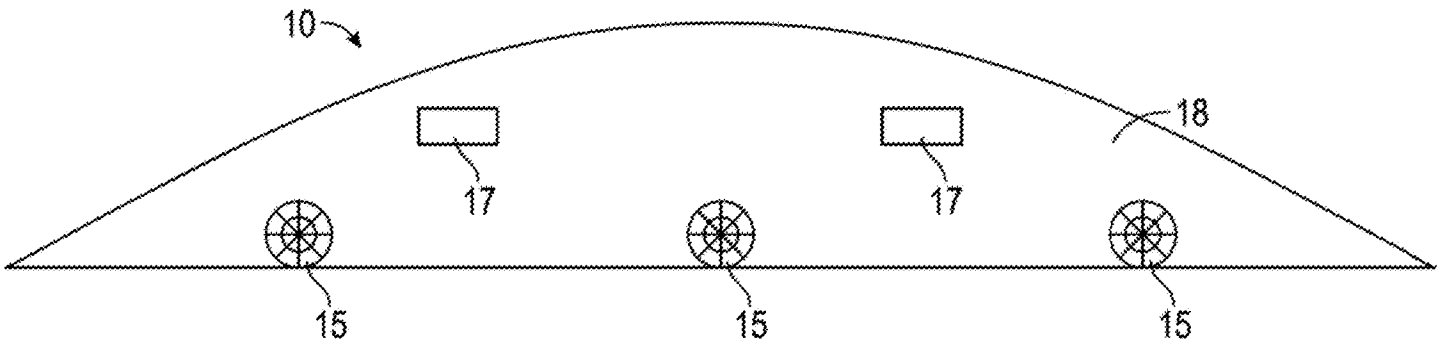
FIG. 5 shows a front view of a particulate pile covered by an oval-shaped storage cover having vents wherein the perimeter of the storage cover lays on the ground.
Figure 6:
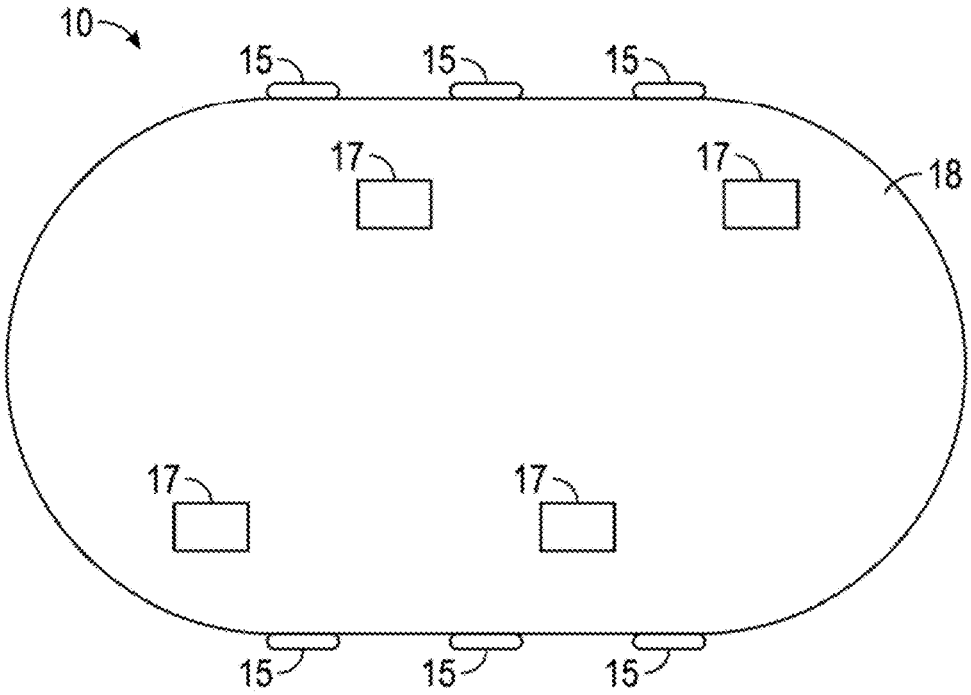
FIG. 6 shows a plan view of a particulate pile covered by an oval-shaped storage cover having vents.

Storage covers 10 for covering particulate piles can come in a variety of sizes and shapes, are made from a variety of materials, and often are designed to specific customer specifications. FIG. 1 shows a side view of a particulate pile surrounded by a retaining wall 12, secured by angle iron braces 14, and covered by a circular-shaped storage cover 10. FIG. 4 shows a side view of an alternative configuration wherein a particulate pile is surrounded by a retaining wall 12 and covered by an oval-shaped storage cover 10. FIG. 5 shows yet another alternative configuration wherein the storage cover 10 is secured to the ground rather than a retaining wall 12.

The retaining wall 12 can be solid or perforated (as shown in FIGS. 1 and 4). When the retaining wall 12 comprises perforations 16, this allows for air to flow through the retaining wall 12. The tarp body 18 may be made from a variety of materials. However, usually the tarp body 18 is made from a water-proof, non-permeable fabric, such as polyvinylchloride or polyethylene, that protects the particulate material from rain, moisture and weather, but does not allow air to flow through the tarp body 18.

It is advantageous to aerate a covered particulate pile to prevent molding, moisture migration, and insect or rodent infestation. To aerate a particulate pile, aeration fans 15 may be installed along the perimeter of the storage cover 10 (as can be seen in FIGS. 1-7) to draw air out of the particulate pile. The aeration fans 15 can be of any of the types and sizes known in the art, and are generally selected based on customer specifications. For example, a Grain Guard™ galvanized vane axial or centrifugal aeration fan (sold by Ag Growth International) may be used. Generally, aeration fans 15 are installed every 20-30 feet, but may be installed closer together or farther apart.

In an attempt to draw air from the interior of the particulate pile, rather than from just the perimeter of the pile (where the fans are located), aeration pipes 30 are attached to the aeration fans 15 and positioned on the ground prior to depositing the particulate material. Aeration pipes 30 are generally made from perforated corrugated polyethylene pipe, but pipes made of metal and other types of plastics and materials known in the art may also be utilized. Aeration pipes 30 of various diameters may also be used with aeration pipes 30 generally being 12-24 inches in inner diameter.

Figure 7:
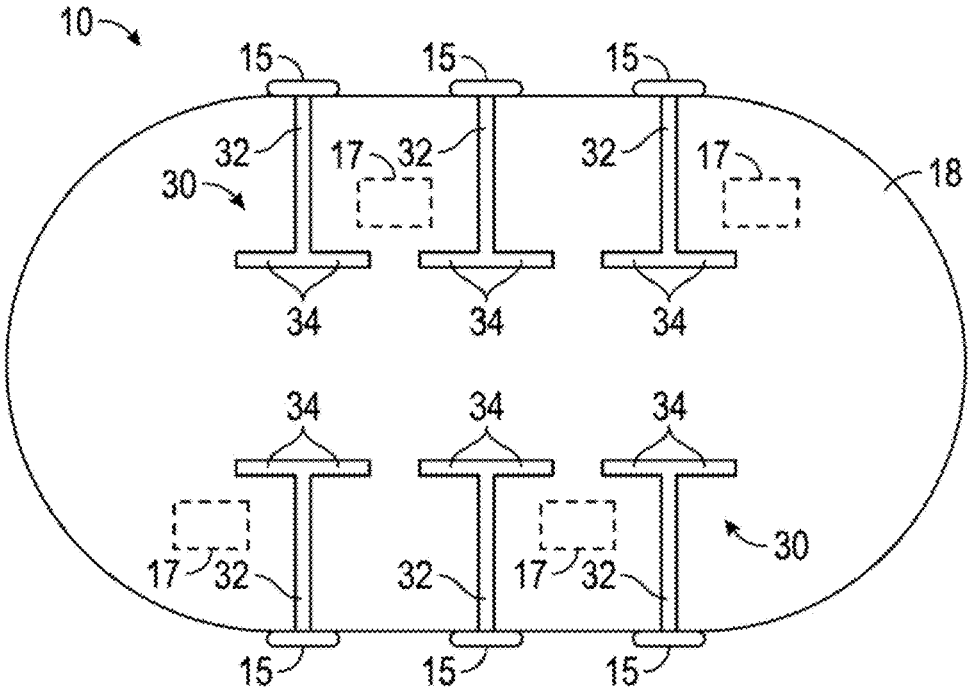
FIG. 7 shows an interior plan view of a particulate pile, outfitted with aeration pipes and fans, covered by an oval-shaped storage cover having vents.

The aeration pipes 30 can be configured in various arrangements. For example, FIG. 7 depicts aeration pipes 30 in a T-shaped arrangement with an aeration pipe stem 32 attached to an aeration fan 15 and two aeration pipe arms 34 attached to, and extending away from, the distal end of the aeration pipe stem 32. The length of the aeration pipe stem 32 and each of the two aeration pipe arms 34 depend on the size of the particulate pile and customer specifications. In one example, the aeration pipe stem 32 is 60 feet in length and the pipe arms are each 40 feet in length. In this configuration, air is drawn through the distal ends of the aeration pipe arms 34 and through the perforations in the lengths of the aeration pipes 30 in an attempt to more uniformly pull air from the bottom of the particulate pile.

Figure 3:
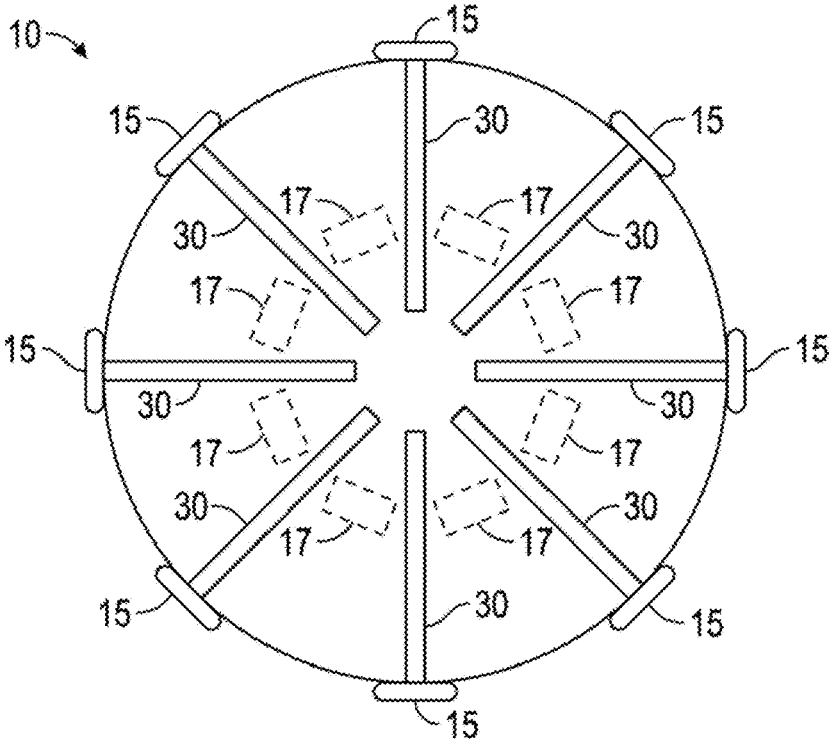
FIG. 3 shows an interior plan view of a particulate pile, outfitted with aeration pipes and fans, covered by a circular shaped storage cover having vents.

An alternate configuration of aeration pipes 30 is shown in FIG. 3. In this configuration, single aeration pipe 30 is attached to an aeration fan 15 and extends towards the center of the particulate pile. In this configuration, air is drawn through the distal end of the aeration pipe 30 and through the perforations in the lengths of the aeration pipes 30 in an attempt to more uniformly pull air from the bottom of the particulate pile. Again, the length of the aeration pipes 30 will depend on the size of the particulate pile and customer specifications, but, in one example, the aeration pipes are each 100 feet in length. However, even with the use of theses aeration pipes 30, air flow is still concentrated at the bottom of the pile rather than throughout the height of the pile.

The present invention incorporates a vent 17, or multiple vents 17, within the tarp body 18 of the storage cover 10. We speculate that this increases the effectiveness and efficiency of the aeration of the particulate pile by creating air flow pathways that extend from the vents 17 (located at or near the top of the pile) to the fans (located at or near the bottom of the pile). Thus, we speculate that the present invention will advantageously provide aeration through the height of the particulate pile and not at just the base of the particulate pile.

Figure 8A:
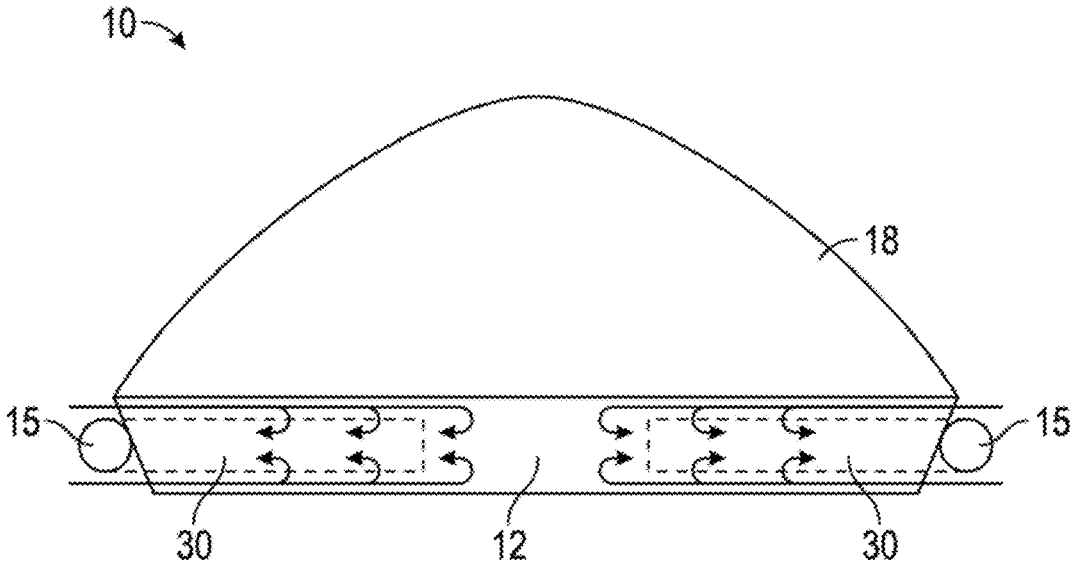
FIG. 8A shows the pathway of aeration air through a particulate pile covered by a storage cover without vents.
Figure 8B:
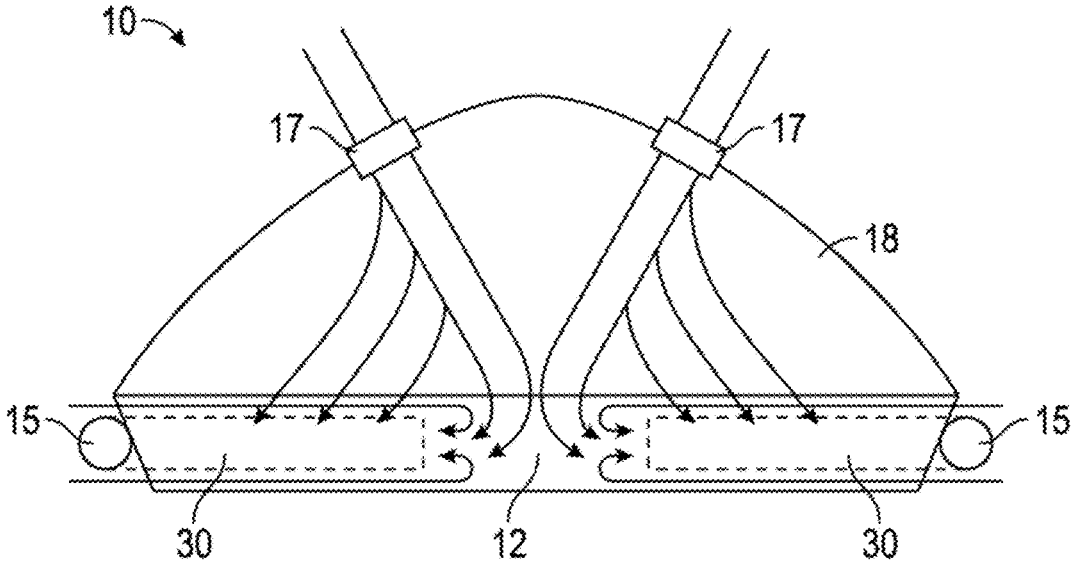
FIG. 8B shows the pathway of aeration air through a particulate pile covered by a storage cover with vents.

As can be seen in FIG. 8A, when a solid tarp body 18, without vents 17, is used while aerating a particulate pile, air enters through the perforations 16 of the retaining wall 12, and then during aeration, the aeration fans 15 pull the air through the aeration pipes 30 and out of the pile. However, in this arrangement, air only flows through the base of the particulate pile (as depicted by the arrows in FIG. 8A). However, when the vents 17 of the present invention are incorporated into the storage cover 10, we speculate that the vents 17 will provide an additional source of aeration air. As shown in FIG. 8B, in this embodiment during aeration, we speculate that the aeration fans 15 pull air from the top of the pile to the base of the pile and through the aeration pipes 30 and out of the pile. Thus, by utilizing the vents 17 of the present invention, we speculate that a more even distribution of aeration air is created that will flow through a greater area of the particulate material.

The number of and location of the vents 17 incorporated into the tarp body 18 may vary based on customer preferences. As one example, FIG. 3 shows eight vents 17 placed so that they are located between the aeration pipes 30 when viewed in the plan view. While FIG. 3 shows one vent 17 between each aeration pipe 30, more or less vents 17 could be utilized and the vents 17 could alternatively be located above the aeration pipes 30. Additionally, the vents 17 can be placed at various distances from the center of the tarp body 18. In one example, the vents 17 are between 5 and 30 feet from the center of the tarp body 18. As another example, FIG. 7 shows four vents 17 placed so that they are located between the aeration stems 34 when viewed in the plan view. Again, greater or fewer vents 17 could be utilized, and may be placed in various locations, depending on the customer's specifications. In one example, the vents 17 are between 5 and 15 feet from the longitudinal center line of the oval-shaped tarp body 18. We speculate that there will be a better distribution of aeration air through the particulate pile if the vents 17 are not directly above the aeration pipes 30 (or, in other words, if the vents 17 are offset from the vertical plane created by the length of the aeration pipes 30).

Figure 9A:
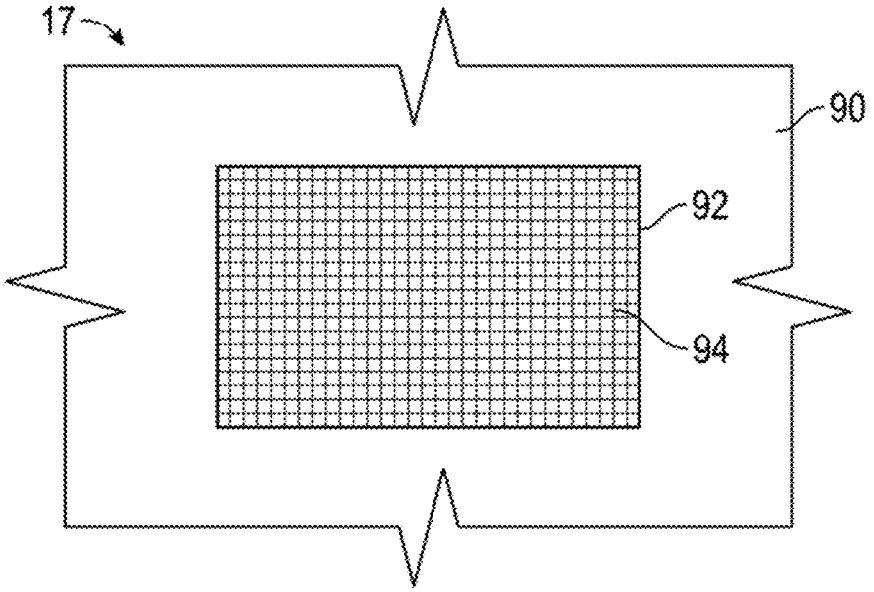
FIG. 9A shows a plan view of a vent comprised of a single opening covered by mesh.
Figure 9B:
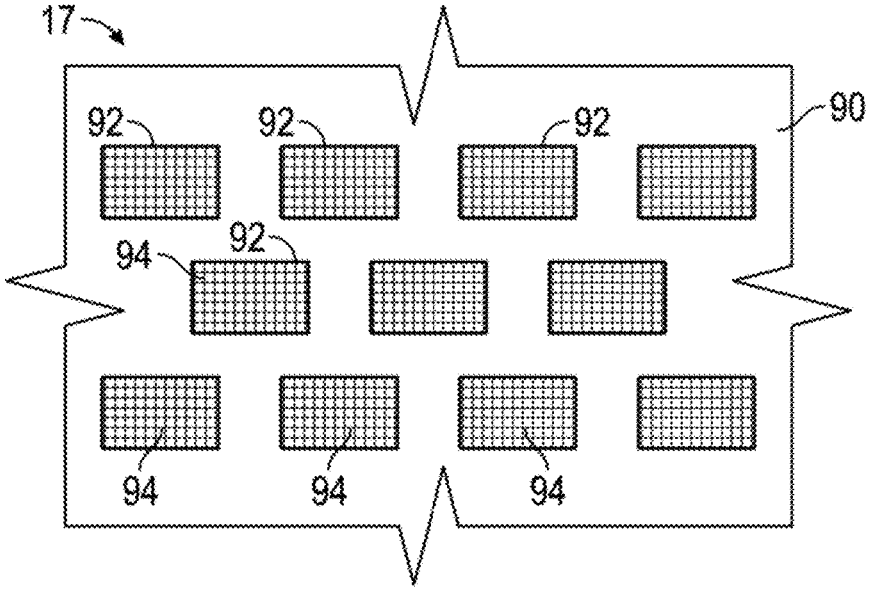
FIG. 9B shows a plan view of a vent comprised of multiple openings covered by mesh.

The vents 17 themselves may also exist in various configurations. As shown in FIG. 9A, the vent 17 may comprise a single vent opening 92. In one example, the vent opening 92 is rectangular in shape and is approximately 7 feet by 6 feet. In another example, the vent opening 92 is between 25 and 100 square feet in area. However, the vent openings may be larger or smaller depending on the size of the particulate pile and customer specifications. Alternatively, as shown in FIG. 9B, the vent 17 may comprise multiple vent openings 92. These vent openings 92 may be square, rectangular, circular or another shape. In one example, the vent openings 92 are each square in shape and are 1 to 2 feet by 1 to 2 feet in size with approximately 6 inches between each vent opening 92. Additionally, the vent openings 92 (whether single or multiple) may be covered by a mesh layer 94. Various types of meshes known in the art can be used for the mesh layer 94. In one example, the mesh layer 94 is made of TenCate Nicolon® 47719 fabric. We speculate that this mesh layer 94 will serve to keep the particulate material from escaping out of the vents 17 of the storage cover 10.

Figure 11A:
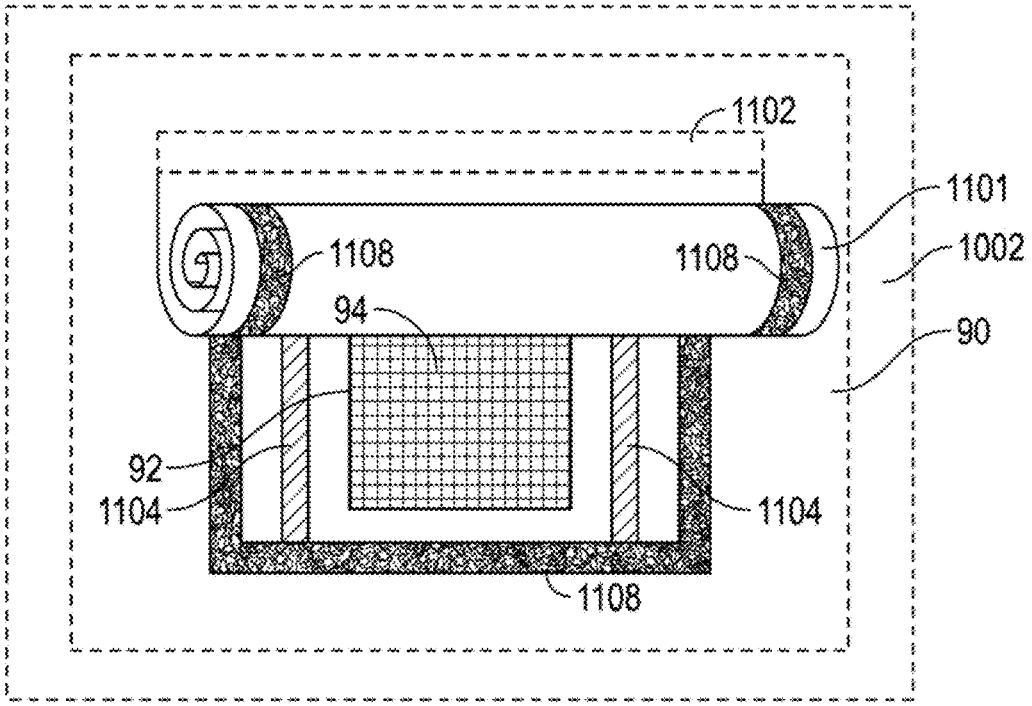
FIG. 11A shows a vent with a flap in the rolled-up position.
Figure 11B:
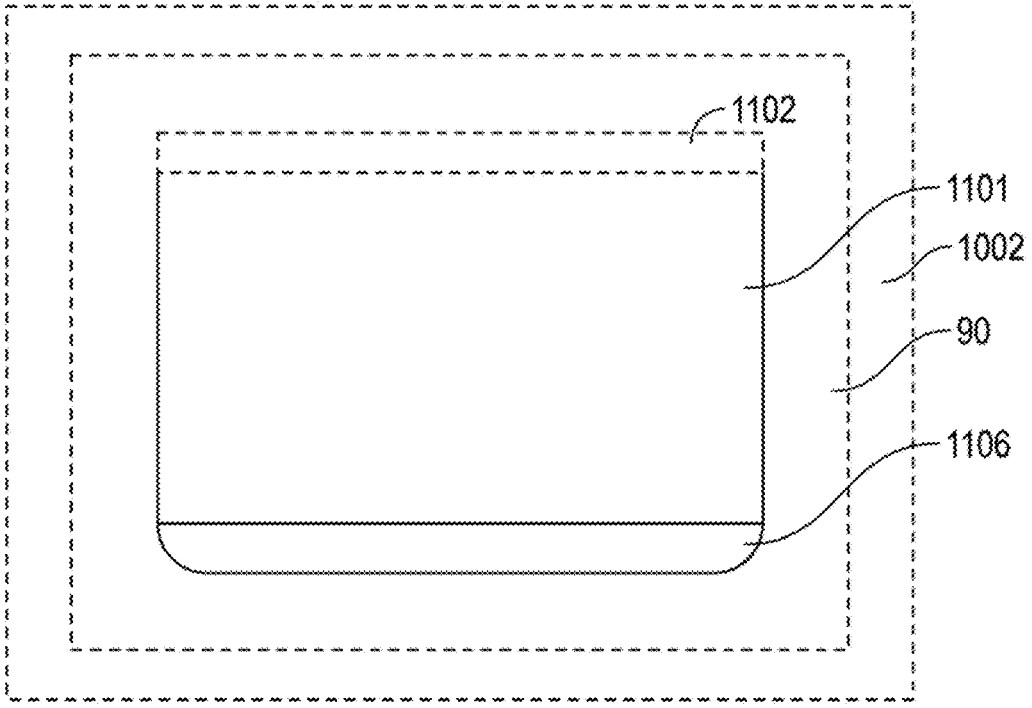
FIG. 11B shows a vent with a flap in the rolled-down positions.

Because the vents 17 may provide a pathway for rain, moisture and other weather to enter the particulate pile (which is undesirable), it is advantageous to also incorporate a method of covering the vents 17 when inclimate weather is expected. One embodiment for covering the vents 17 is using flaps 1101, as shown in FIGS. 11A and 11B. The flaps 1101 can be made of the same or a different material than the tarp body 18. As an example, the flaps 1101 may be made from polyvinylchloride or polyethylene. FIG. 11A shows a flap 1101 for covering the vent opening 92 wherein the flap 1101 is shown in the rolled-up position.

The top of the flap 1101 is connected at the flap seam 1102 to the area surrounding the vent (also referred to as the vent body 90). The flap 1101 can be connected to the vent body 90 by sewing, gluing, heat sealing or using other attachment methods known in the art. The flap 1101 can be rolled-up to allow air to enter the particulate pile, and, alternatively, when inclimate weather is expected, the flap 1101 can be un-rolled to cover the vent opening 92, as shown in FIG. 11B, thus preventing rain, moisture or other weather from entering the particulate pile. Additionally a method of securing the flap 1101 in the rolled-up position (e.g., hook and loop fasteners, zippers, grommets and zip-ties, etc.) may also be utilized.

The vent opening 92 may also be completely or partially surrounded by a flap fastener 1108 to secure the flap 1101 to the vent body 90 when in the rolled-down position, and to keep out rain, moisture and other weather. The flap fastener 1108 may comprise hook and loop fasteners, zippers, grommets and zip-ties, or other fastening methods known in the art. The vent 17 may also utilize ropes 1104 to divert rain, moisture and other weather away from the vent opening 92. As shown in FIG. 11A, a length of rope 1104 can be placed (by either attaching to the vent body 90 or embedding it within or under the vent body 90) alongside the vent opening 92 to divert rain away from the vent opening 92 and keep moisture out of the particulate pile. Also, the flap 1101 may comprise a flap pocket 1106 at the edge of the flap 1101 opposite the flap seam 1102. A weighted object such as a dowel or pipe may be placed in this flap pocket 1106. The dowel or pipe in the flap pocket 1106 will provide weight to aid in keeping the flap closed against the vent body 90 when the flap 1101 is in the closed or rolled-down position, and can also aid in easily rolling up the flap 1101 when the flap 1101 is in the rolled-up position.

Figure 12:
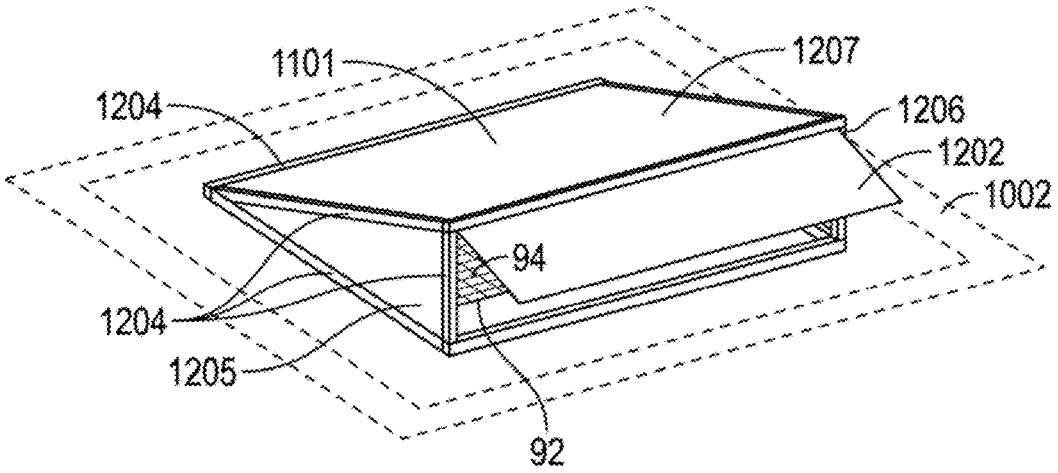
FIG. 12 shows a vent with a flap held in place by a frame and further comprising a flap front cover.

Another embodiment for covering the vents 17 is shown in FIG. 12. In this embodiment a triangular prism shaped frame 1204 is placed around the vent opening 92 and the flap 1101 is attached to the frame 1204 so that the flap 1101 extends over at least a portion of the vent opening 92. The frame 1204 may alternatively be in the shape of a cube, cuboid or another shape. Specifically the flap 1101 shown in FIG. 12 is comprised of a first side flap piece 1205, a second side flap piece 1206, a top flap piece 1207 and a front flap cover 1202. The first side flap piece 1205 and the second side flap piece 1206 are attached to the parallel sides of the triangular prism shaped frame 1204 and the top flap piece 1207 is attached to the top face of the triangular prism shaped frame 1204. The front flap cover 1202 is attached along one edge to the triangular prism shaped frame 1204. This allows the front flap cover 1202 to be placed in the open position (thereby allowing air to enter the pile through the vent 17) or the closed position (thereby blocking rain, moisture and weather from entering the pile through the vent 17). FIG. 12 shows the front flap cover 1202 in between the opened and closed position. Further, the front flap cover 1202 can be secured in the open position by attaching the front flap cover 1202 to the top flap piece 1207 using hook and loop fasteners or any fastening methods known in the art.

Figure 13:
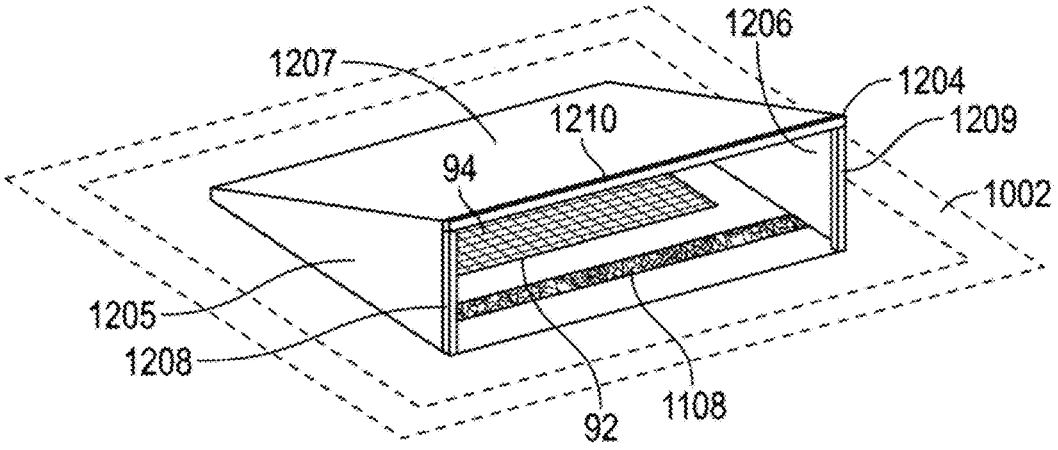
FIG. 13 shows a vent with a flap held in place by a frame and further comprising a flap fastener.

FIG. 13 shows an alternate frame 1204 and flap 1101 design. In this embodiment, the frame 1204 is U-shaped and comprised of a first frame leg 1208, a second frame leg 1209 and a frame center 1210. The frame 1204 is placed adjacent to the vent body 90 so that it extends outward from the vent body 90. In one example, the frame 1204 is placed so that it is perpendicular to the vent body 90. The first side flap piece 1205 and the second side flap piece 1206 are attached to the first frame leg 1208 and the second frame leg 1209 respectively, and the top flap piece 1207 is connected to the frame center 1210. Thus, the U-shaped frame 1204, adjacent to the vent body 90 and extending outward from the vent body 90, holds the flap 1101 away from the vent opening 92 and allows air to enter the particulate pile. In one example, the first and second frame legs 1208, 1209 are each 12 inches in height and the frame center 1210 is 8 feet in length. However, the frame 1204 may be larger or smaller size.

Figure 14:
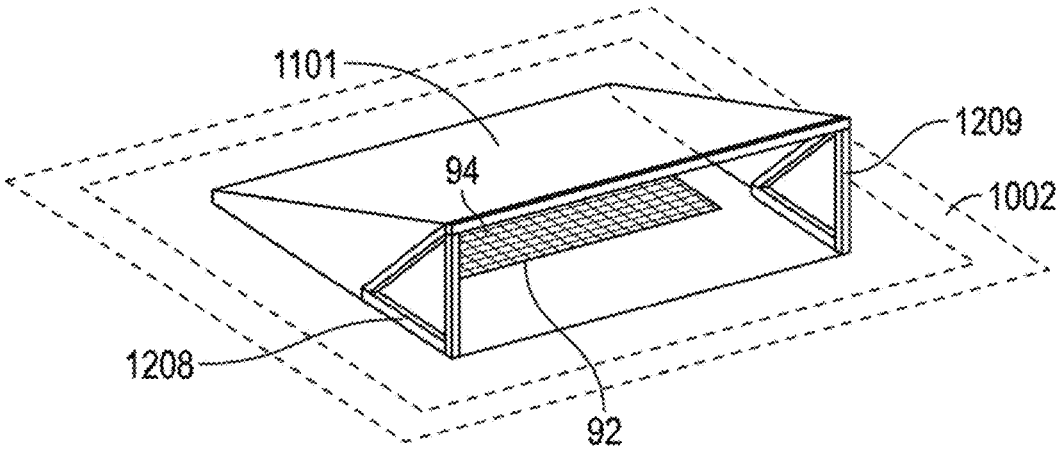
FIG. 14 shows a vent with a flap held in place by a frame with triangular frame legs.

Alternatively, the first frame leg 1208 and the second frame leg 1209 may be triangular in shape or may take another alternative shape. An exemplary frame 1204 with triangular-shaped first and second frame legs 1208,1209 is shown in FIG. 14.

Due to the shape of the frame 1204 (and the flap 1101 covering the frame 1204) we speculate that the flaps 1101 shown in FIGS. 12 and 13 will prevent most rain, moisture and other weather from entering the vent opening 92. However, to further prevent rain, moisture and other weather from entering the vent opening 92 in severe weather, the flap 1101 can be secured in the closed position. For example, in the configuration of FIG. 12, the front flap cover 1202 can be placed in the closed position and fastened to the frame 1204 and/or vent body 90 using hook and loop fasteners or any other fastening method known in the art.

Figure 15:
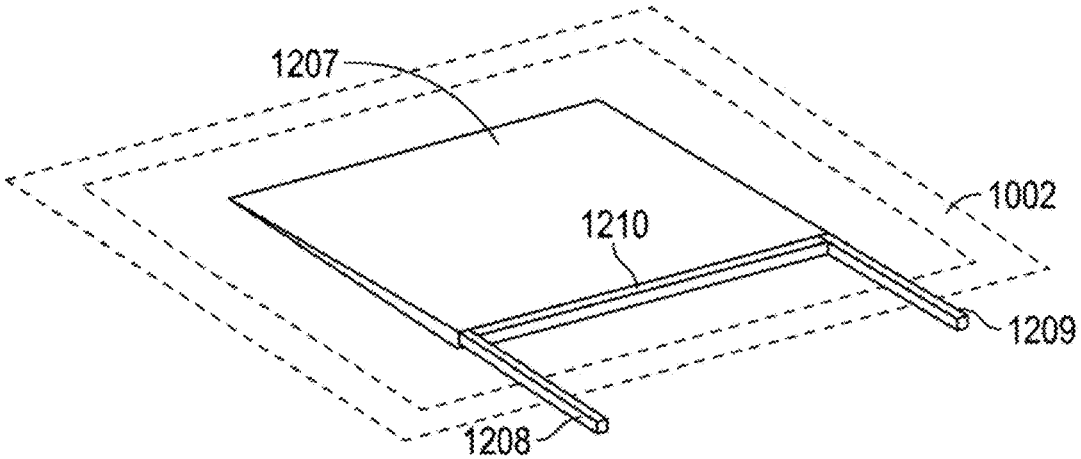
FIG. 15 shows a vent with a flap in the closed position covering the vent opening.

The embodiment of FIG. 13 can be constructed so that the first frame leg 1208 and the second frame leg 1209 are removably connected to the first side flap piece 1205 and the second side flap piece 1206, thus allowing the first and second frame legs 1208, 1209 to be disconnected from the first and second flap pieces 1205, 1206 and placed parallel to the vent body 90. By disconnecting and laying the first and second frame legs 1208,1209 parallel to the vent body 90, it allows the top flap piece 1207 to collapse and cover the vent opening 92, further preventing rain, moisture and other weather from entering the vent opening 92 in severe weather. The frame 1204 with the first and second legs 1208, 1209 disconnected from the first and second flap pieces 1205, 1206 is shown in FIG. 15. Alternatively, the vent 17 can be constructed so that the frame 1204 is completely removable from the first side flap piece 1205, the second side flap piece 1206 and the top flap piece 1207. Optionally, after collapsing the top flap piece 1207, the top flap piece 1207 can further be secured to the vent body 90 using hook and loop fasteners or any fastening methods known in the art.

Figure 16:
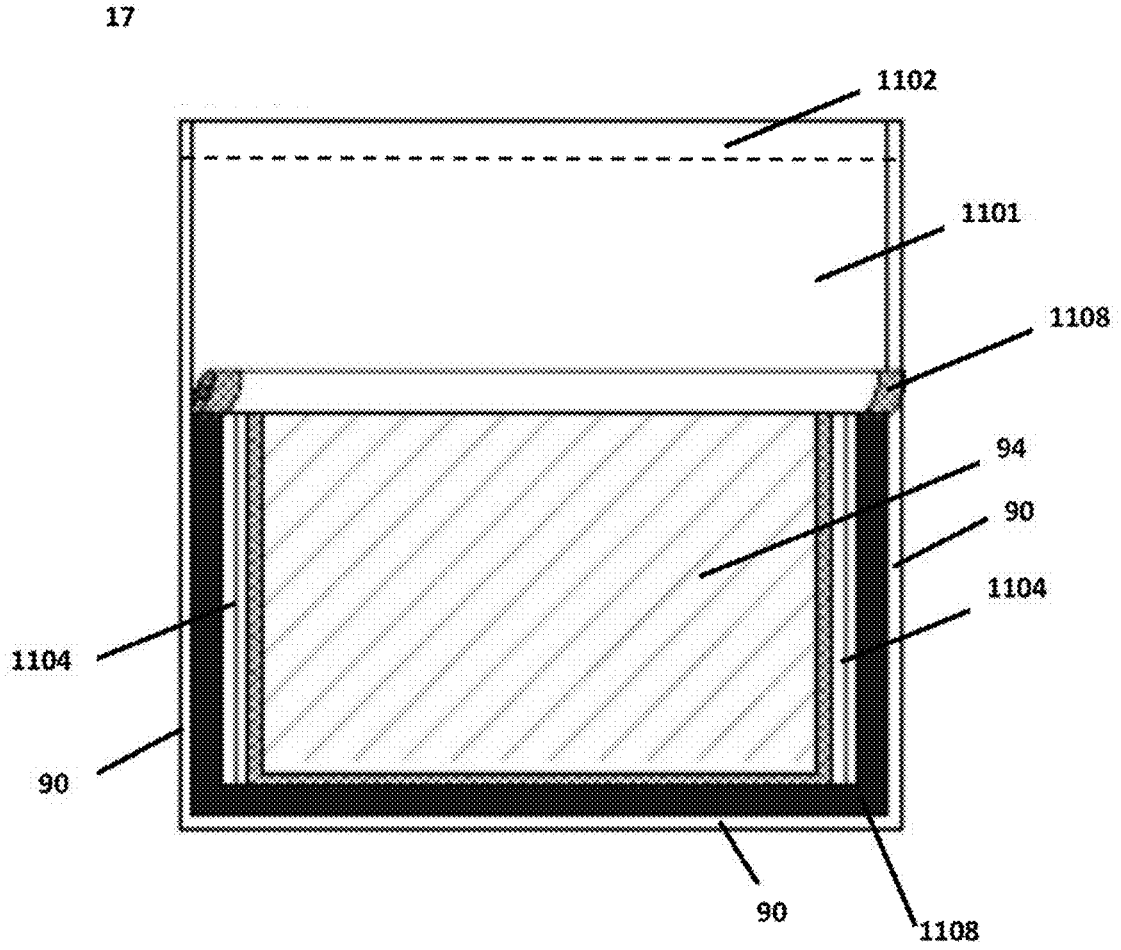
FIG. 16 shows a plan view of a vent comprising a solid vent body and a removably attached mesh layer wherein the flap is lifted to expose the mesh layer.
Figure 17:
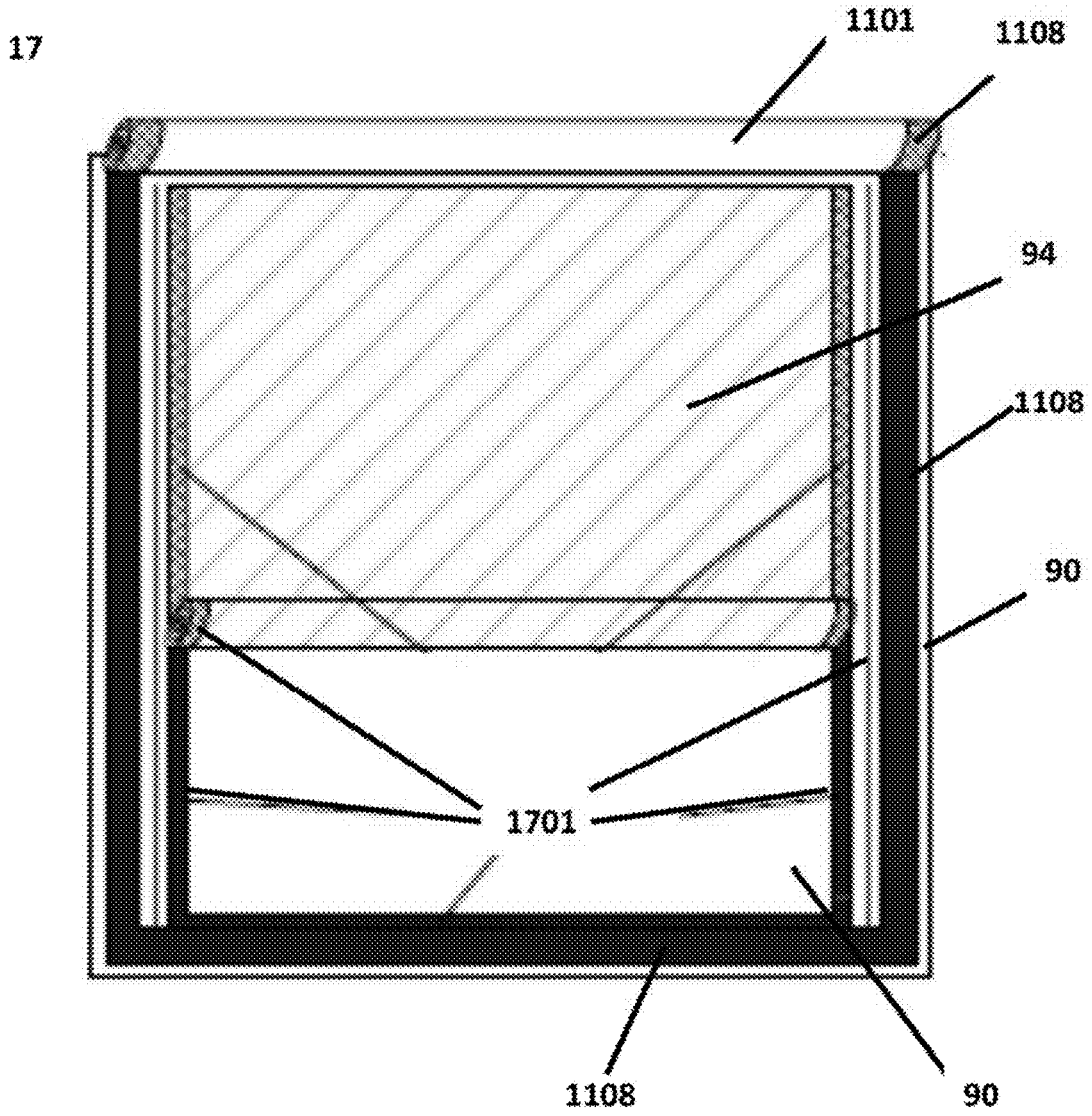
FIG. 17 shows a plan view of a vent comprising a solid vent body and a removably attached mesh layer wherein the mesh layer is lifted to expose the solid vent body.

In an alternate embodiment, the vent 17 is separate and distinct piece from the tarp body 18 to allow for the vent 17 to be installed after a storage cover 10 is deployed. In this embodiment, as shown in FIGS. 16 and 17, the vent 17 is comprised of a solid vent body 90 wherein a flap 1101 is attached to the top of the vent body 90 at the flap seam 1102. The flap 1101 can be connected to the vent body 90 at the flap seam 1102 by sewing, gluing, heat sealing or using other attachment methods known in the art. As with the previously described embodiments, the flap 1101 can be in the rolled-up position or the rolled-down position. FIG. 16 shows the flap 1101 partially rolled-up. Additionally a method of securing the flap 1101 in the rolled-up position (e.g., hook and loop fasteners, zippers, grommets and zip-ties, etc.) may also be utilized.

The vent 17 may further comprise a flap fastener 1108 along the perimeter of the vent body 90 and along the perimeter of the underside of the flap 1101 so that the flap 1101 may be removably attached to the vent body 90 if desired. The flap fastener 1108 may comprise hook and loop fasteners, zippers, grommets and zip-ties, or other fastening methods known in the art. The vent 17 may also utilize ropes 1104 to divert rain, moisture and other weather away from the vent opening 92. As shown in FIG. 16, a length of rope 1104 can be placed (by either attaching to the vent body 90 or embedding it within or under the vent body 90) substantially parallel to the side edges of the vent body 90 to divert rain away from the center of the vent 17 and keep moisture out of the particulate pile.

This embodiment of the vent 17 may further comprise a mesh layer 94. In this particular embodiment the mesh layer 94 is removably attached over the solid vent body 90 (in contast to a previously described embodiment, the vent 17 of this embodiment does not comprise a vent opening 92 until after it is attached to the storage cover 10, as is described in detail below). The configuration of this embodiment allows the vent 17 to be more easily installed on an already deployed storage cover 10, as is described in detail below.

FIG. 17 shows the mesh layer 94 partially detached to expose the vent body 90 underneath. The vent 17 may further comprise mesh fasteners 1701 secured to the perimeter of the underside of the mesh layer 94 and to the vent body 90 so that the mesh layer 94 may be attached to or detached from the vent body 90. The mesh fasteners 1701 may comprise hook and loop fasteners, zippers, grommets and zip-ties, or other fastening methods known in the art.

Method of Installing the Ventilation System

Figure 10:
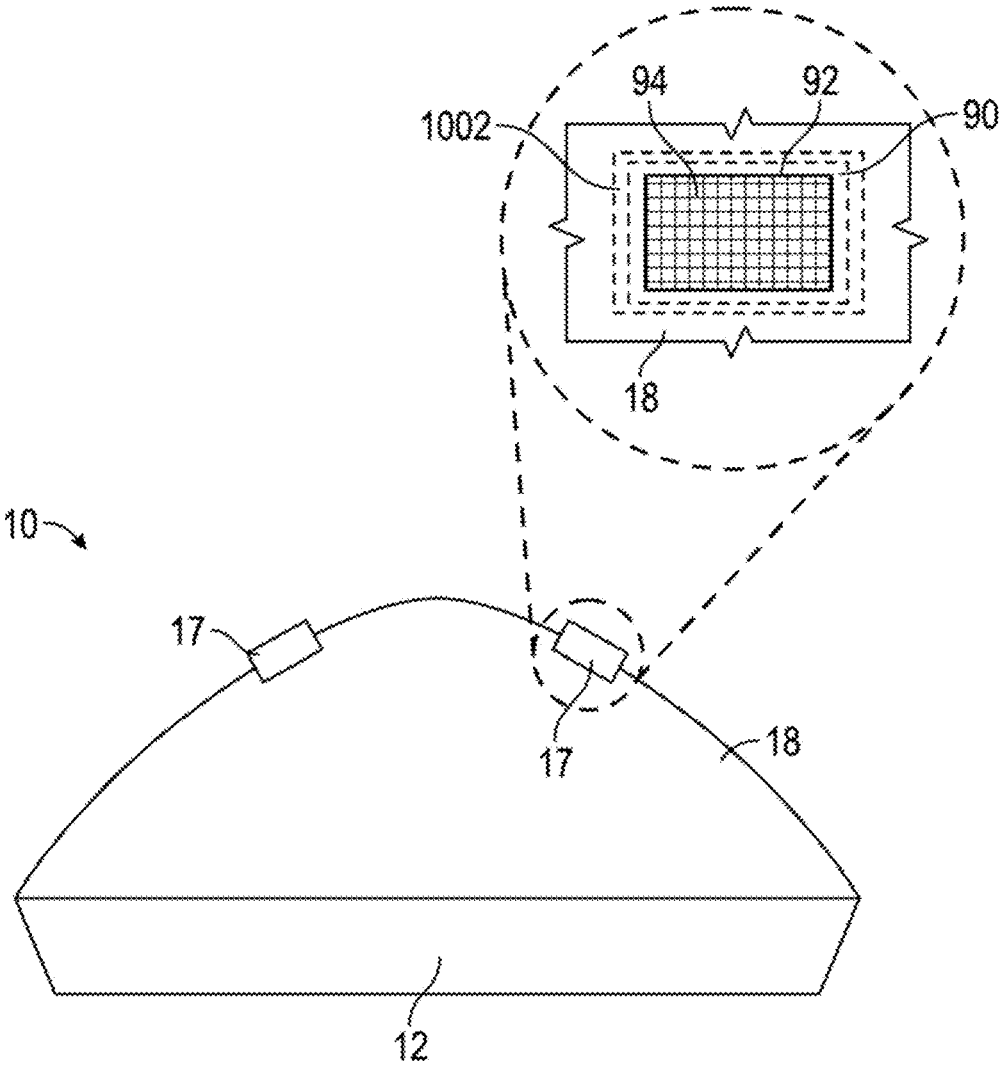
FIG. 10 shows a close-up view of a vent attached to the tarp body of a storage cover.

In one method of installing a vent 17 of the present invention (wherein the vent 17 is comprised of the vent body 90 enclosing the vent opening 92 and any vent flaps 1101 or frame 1204), the vent 17 is taken to the approximate location on the storage cover 10 where the vent 17 is to be installed. An opening of approximately the same shape, but a smaller area, as the vent body 90, is then cut out of the tarp body 18. The vent 17 is then placed either on top of or underneath the newly created opening so that perimeter of the vent body 90 can be attached to the inner edge of the newly created opening, and thereby creating a vent seam 1002 around the perimeter of the vent body 90 that connects the vent body 90 to the tarp body 18. This attachment can be performed by sewing, gluing, heat sealing or any other attachment method known in the art. The attachment of a vent 17 to the tarp body 18 is shown in FIG. 10.

In another method of installing a vent 17 of the present invention, the vent opening 92 is created by cutting an opening out of the tarp body 18 using scissors, a knife or any other cutting device. In this situation, the tarp body 18 and the vent body 90 are one in the same. The flap 1101 (and to the extent desired, ropes 1104 and flap fatteners 1108) is then attached to the area of the tarp body 18 surrounding the newly created vent opening 92 by sewing, gluing, heat sealing or using any other attachment method known in the art. If a mesh layer 94 is desired, the mesh layer 94 is attached to the newly created vent opening 92.

FIGS. 18-27 depict yet another method of installing a vent 17. This method may utilize the vent 17 embodiment shown in FIGS. 16 and 17. We speculate that the vent 17 embodiment shown in FIGS. 16 and 17 will allow for easier installation of a vent 17 on an already deployed storage cover 10. However, the embodiment of FIGS. 16 and 17 may be used in connection with a storage cover 10 that has not already been deployed.

Figure 18:
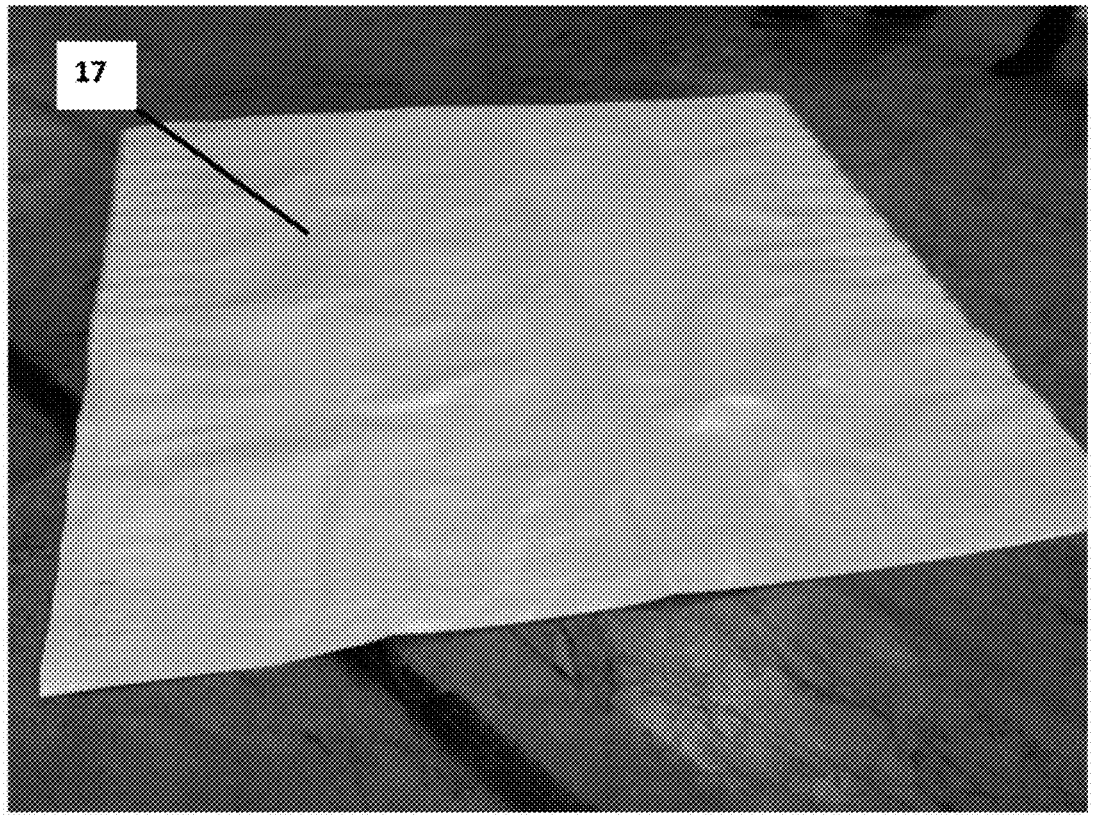
FIG. 18 shows a plan view of a vent prior to installation.
Figure 19:
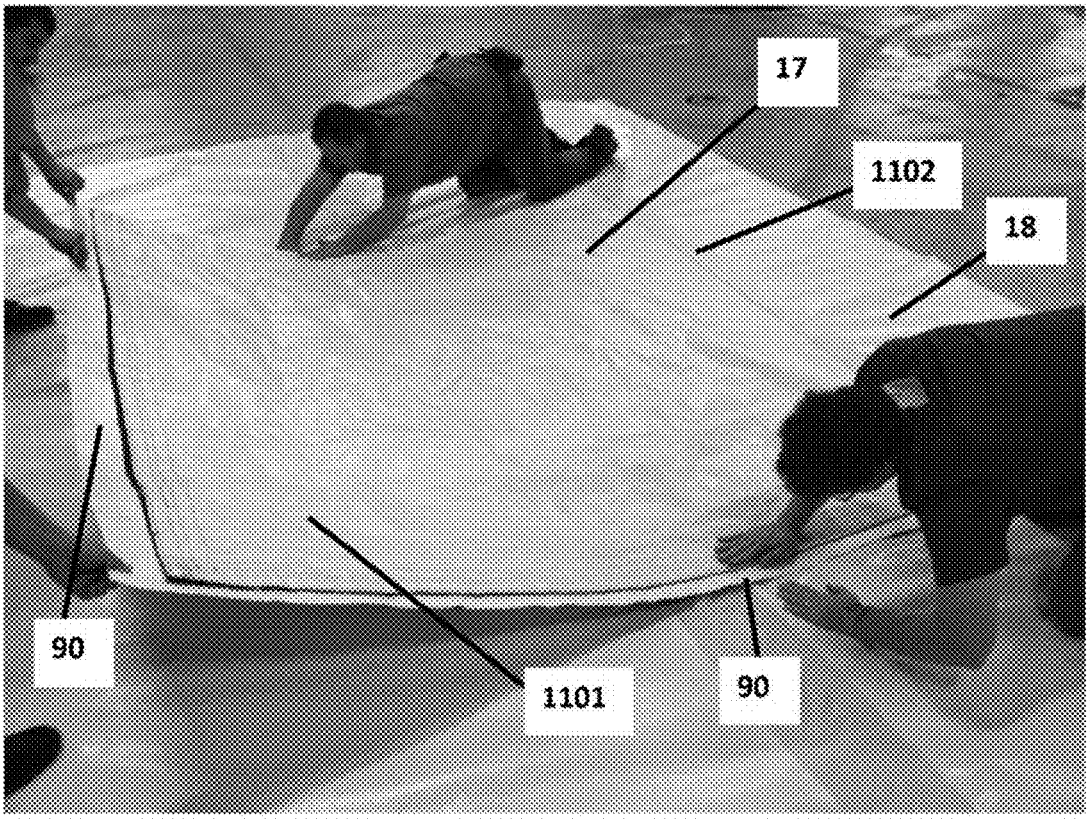
FIG. 19 shows the placement of a vent onto a tarp body.
Figure 20:
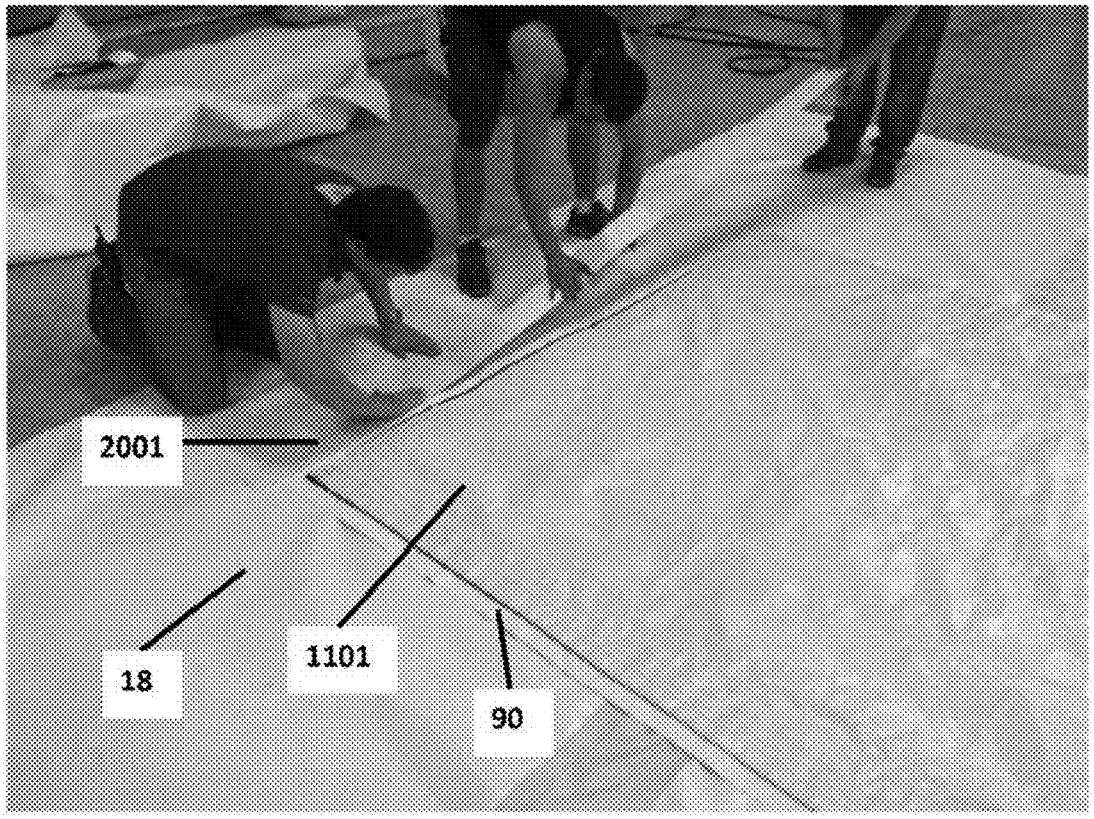
FIG. 20 shows the attachment of the vent to the tarp body using tape.
Figure 21:
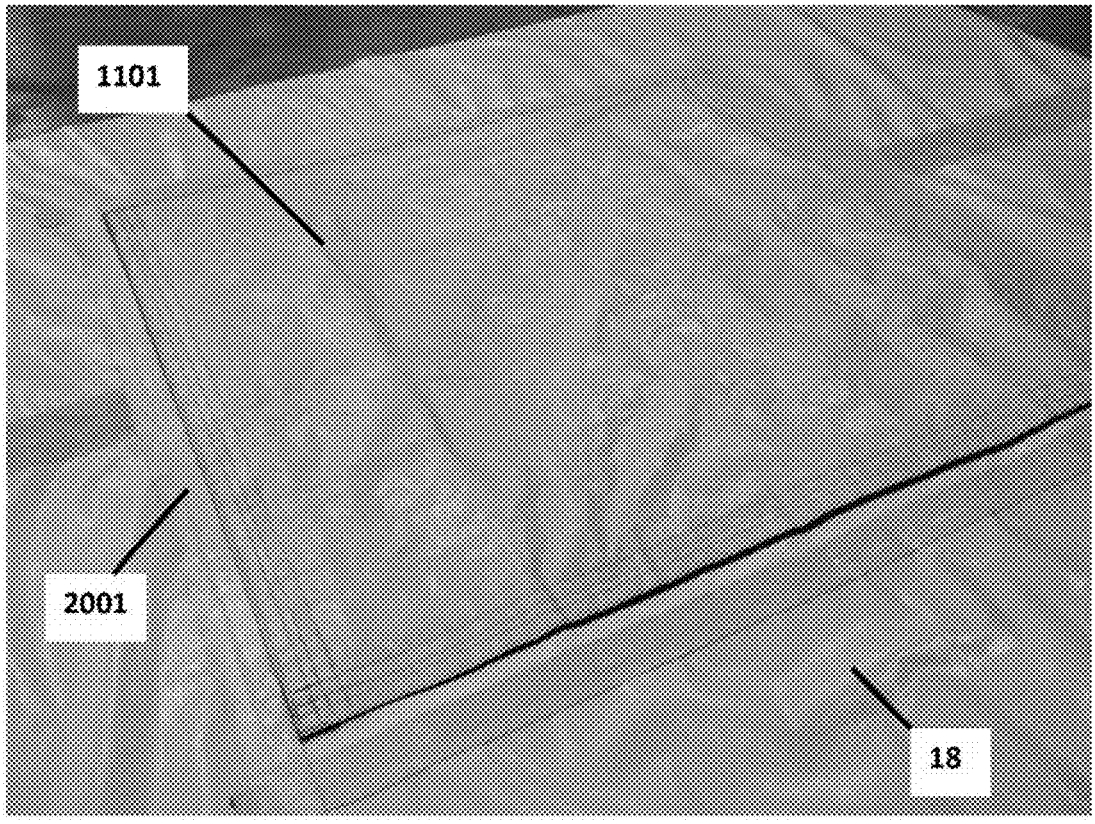
FIG. 21 shows the vent taped to the tarp body.

As shown in FIG. 18, a vent 17 having the embodiment depicted in FIGS. 16 and 17 is utilized. Then, as shown in FIG. 19, the vent 17 is placed on top of the tarp body 18 at the location where ventilation is desired. As shown in FIG. 20, the edges of the vent body 90 are attached to the tarp body 18 using tape 2001 such as 4 inch wide cross linked buyl, polyethylene back tape (alternatively, the edges of the vent body 90 can be attached to the tarp body 18 by sewing, gluing, heat sealing or using any other attachment method known in the art). FIG. 21 depicts the vent 17 attached using tape 2001 to the tarp body 18. Optionally, it may be desirable to also utilize double sided tape along the perimeter of the underside of the vent body 90 to further secure the vent body 90 to the tarp body 90.

Figure 22:
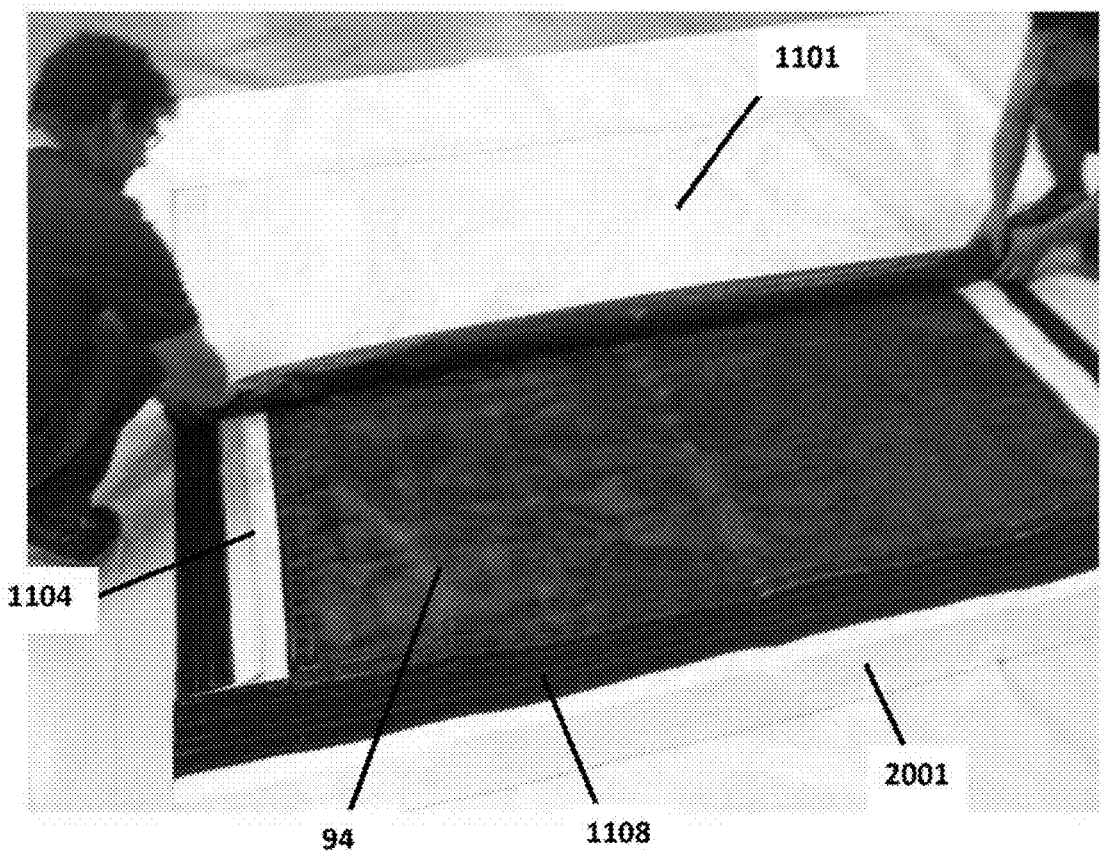
FIG. 22 shows the lifting of the flap to expose the mesh layer.
Figure 23:
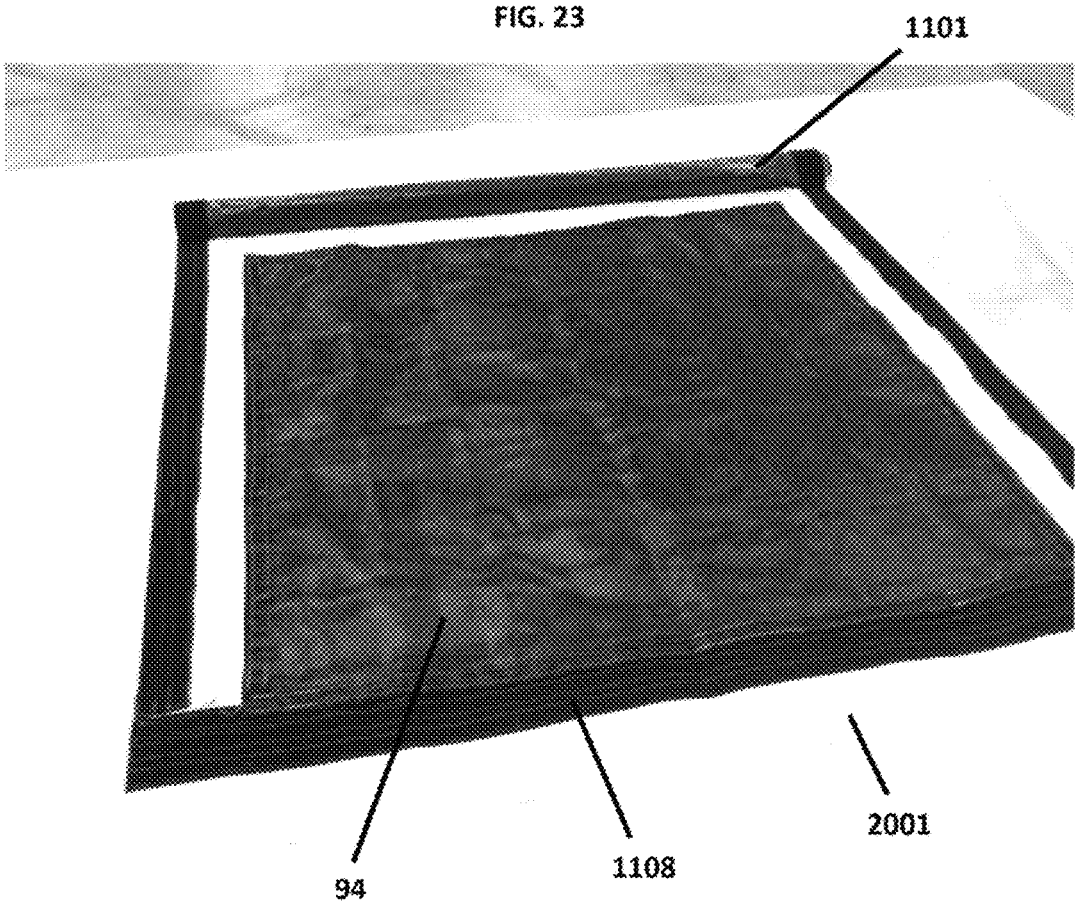
FIG. 23 shows the flap in a fully rolled-up position and exposing the mesh layer.
Figure 24:
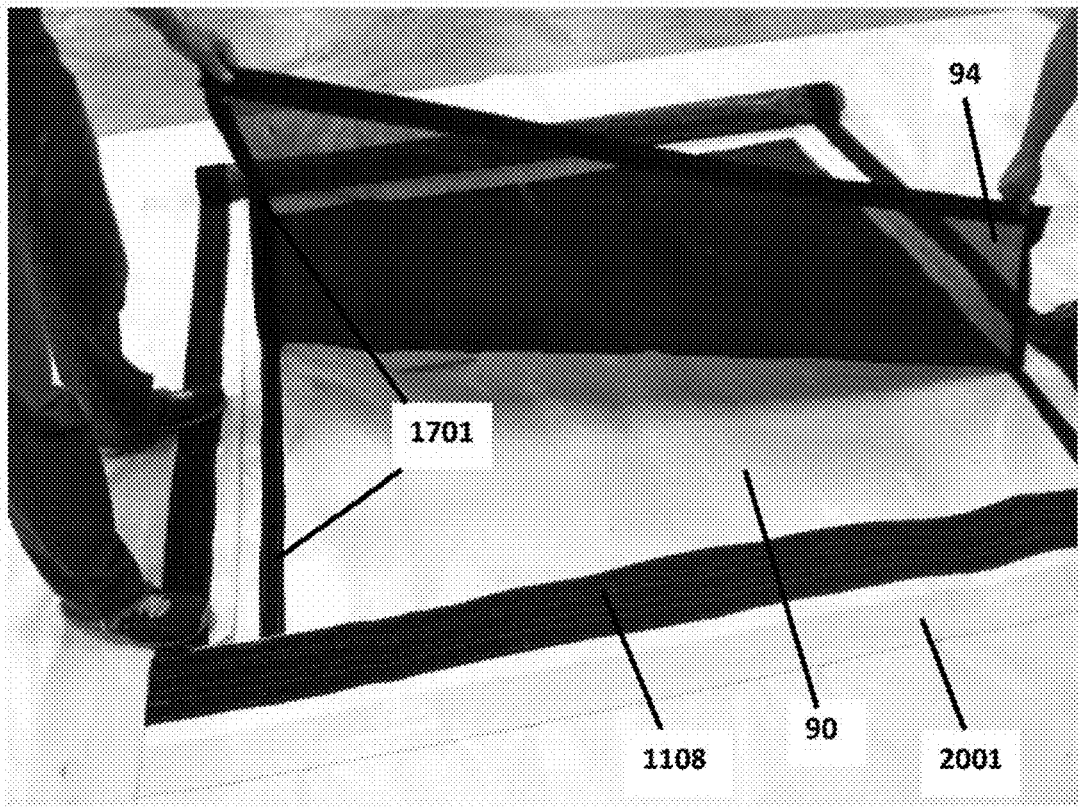
FIG. 24 shows the lifting of the mesh layer to expose the vent body.
Figure 25:
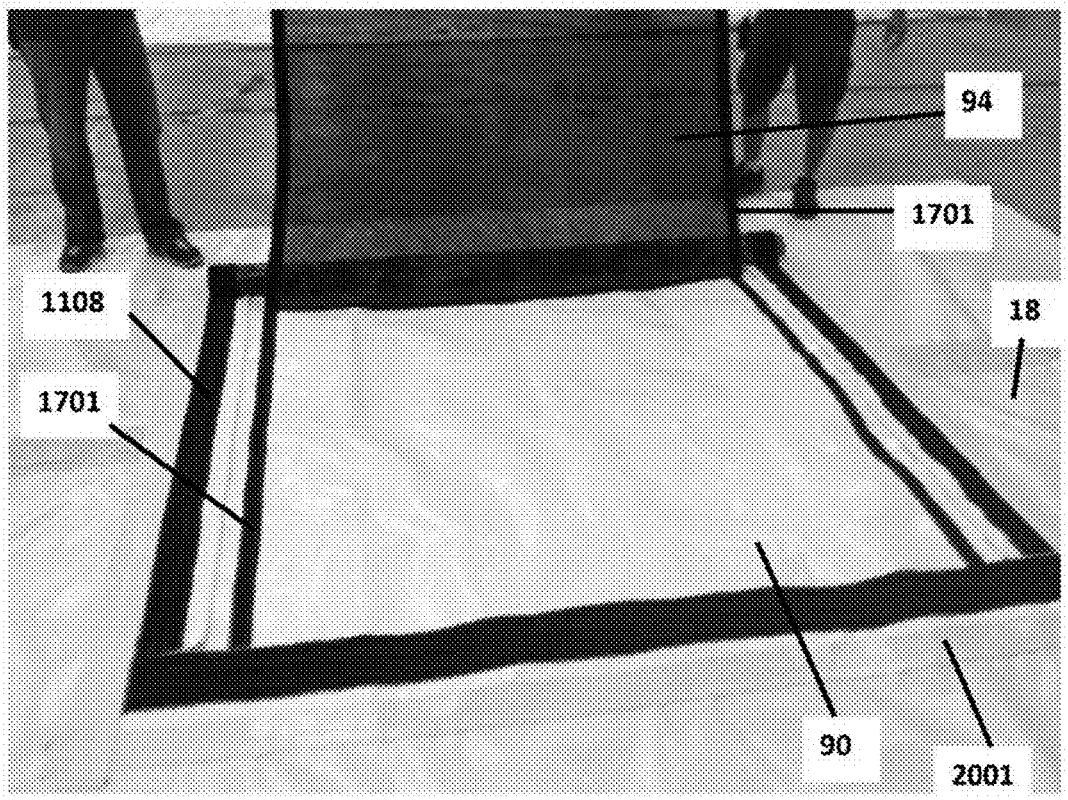
FIG. 25 shows the mesh layer fully lifted and exposing the vent body.

Then, as shown in FIG. 22, the flap 1101 is lifted to expose the mesh layer 94 underneath. FIG. 23 shows the flap 1101 in the fully rolled-up position to fully expose the mesh layer 94. The mesh layer 94 is then detached to expose the vent body 90 underneath.

Figure 26:
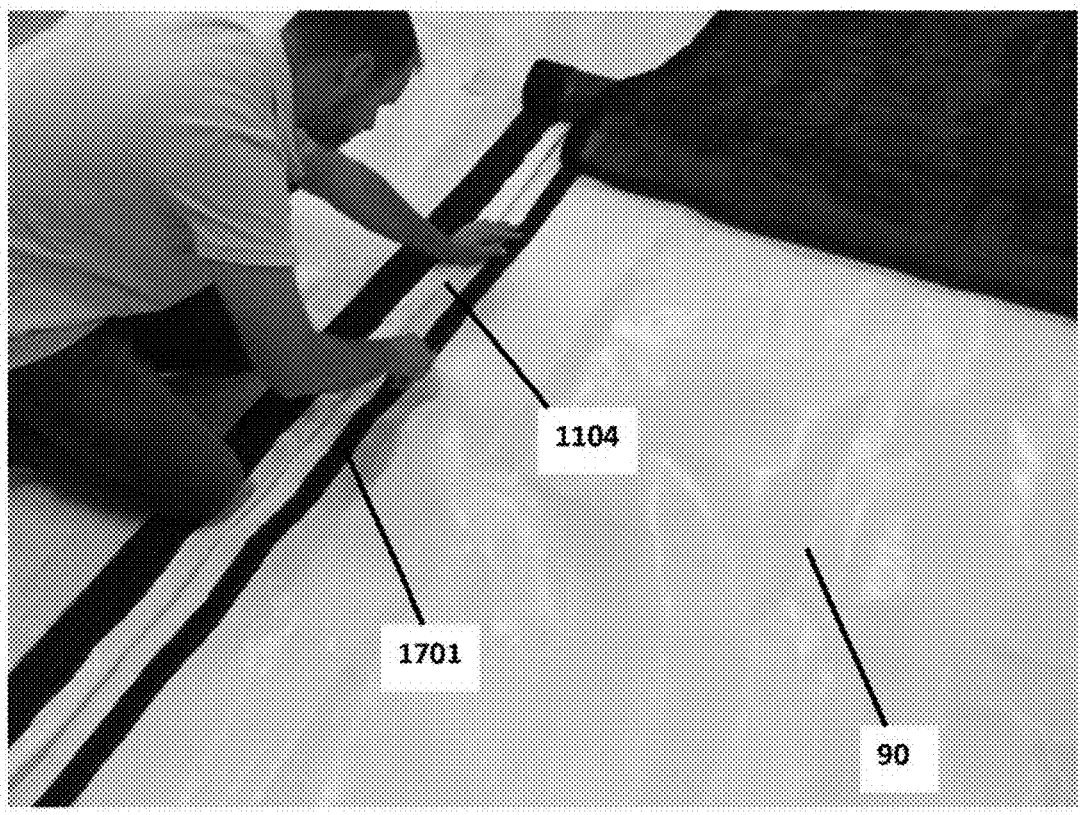
FIG. 26 shows the cutting away of the vent body to expose the tarp body.
Figure 27:
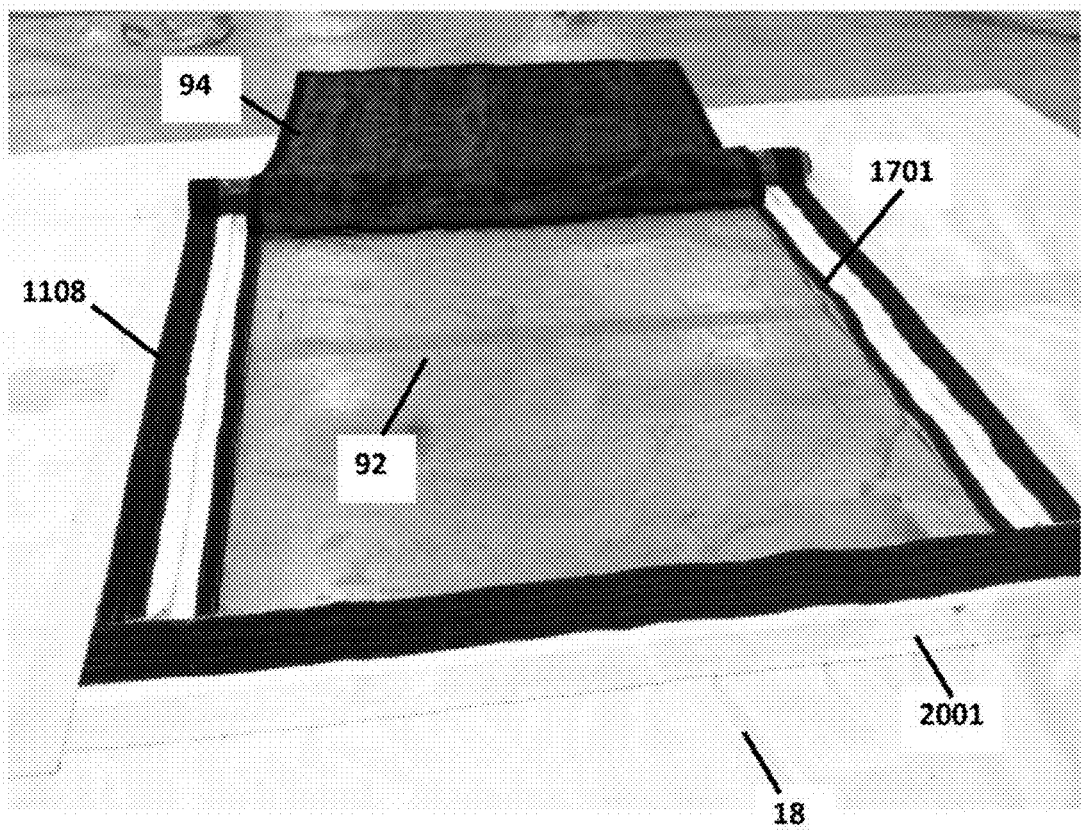
FIG. 27 shows the installed vent after the both the vent body and tarp body have been cut away.

Next, as shown in FIG. 26, a portion of the vent body 90 is cut away, using scissors a knife or any other cutting device known in the art, to create a vent opening 92. The vent body 90 may be cut to create a vent opening 92 in various shapes or sizes. However, we speculate that it will be advantageous to remove as much of the vent body 90 located inside the mesh fasteners 1701 as possible, as this will allow the maximum amount of ventilation through the vent opening 92. Then, the portion of tarp body 18 that is exposed through the vent opening 92 is also cut out to expose the particulate to the atmosphere and allow ventilation. The portions of the vent body 90 and tarp body 18 that have been cut out may then be discarded.

After the vent opening 92 is created and the desired portion of the tarp body 18 removed, the mesh layer 94 may be reattached to the vent 17 via the mesh fasteners 1701 so that the mesh layer 94 fully covers the vent opening 92, thus keeping the particulate material from escaping out of the vent opening 92 of the storage cover 10. The flap 1101 may then be reattached to the vent 17 via the flap fasteners 1108 to prevent rain, moisture and other weather from entering the vent opening 92. Alternatively, if rain, moisture or other weather is not a concern, the user may decide not to reattached the flap 1101.

We speculate that the embodiment shown in FIGS. 16-17 and installed using the method shown in FIGS. 18-27, will be particularly useful when installing a vent 17 within a storage cover 10 that is already deployed. As previously discussed, it is advantageous to install vents 17 near the top of the storage cover 10 to increase the air flow through the height of the particulate pile. However, installing these vents 17 at the top of the deployed storage cover often results in the installation persons be exposed to high winds and inclimate weather during installation. Because the vent 17 is attached first, before removing a portion of the tarp body 10, it will prevent the user from having to carefully line up the vent 17 so that it correctly aligns with an opening previously made in the tarp body 10, a task that we speculate would be very difficult in windy conditions or inclimate weather.

Additionally, we speculate that the vent 17 embodiment of FIGS. 16 and 17 wherein the mesh layer 94 and flap 1101 are located above the solid vent body 90 (and thereby the vent body 90 creates a flat, smooth bottom surface) will allow for easier to transportion and placement of the vent 17 at the top of the storage cover 10. However, in an alternate installation method, the vent opening 92 may be created prior to attaching the vent 17 to the storage cover 10.

The invention claimed is:

1. A method for installing comprising the steps of:

a. providing a vent wherein said vent comprises a vent body wherein said vent body has a perimeter; a mesh layer removably attached to said vent body wherein said mesh layer is movable from an attached to a detached position and wherein when said mesh layer is in said attached position, said mesh layer at least partially covers said vent body; and a flap attached to said vent body wherein said flap is movable from an opened position to a closed position and wherein when said flap is in said closed position, said flap covers said mesh layer;

b. providing a tarp body;

c. placing said vent on top of said tarp body;

d. attaching said perimeter of said vent body to said tarp body;

e. moving said flap to at least a partially open position;

f. moving said mesh layer to at least a partially detached position;

g. removing a portion of said vent body to expose a portion of said tarp body; and h. removing a portion of said exposed tarp body.

2. The method of claim 1 further comprising the step of moving said mesh layer into said attached position.

3. The method of claim 2 further comprising the step of moving said flap into said closed position.

4. The method of claim 1 wherein said vent body is between 25 and 100 square feet in area.

5. The method of claim 1 wherein said mesh layer has a perimeter and said mesh layer is removably attached to said vent body by a mesh fastener located at least partially along said perimeter of said mesh layer.

6. The method of claim 1 wherein said flap has a perimeter and said flap is removably attached to said vent body by a flap fastener located at least partially along said perimeter of said flap.

7. The method of claim 1 wherein said vent further comprises a rope attached to said vent body wherein said rope is located outside said perimeter of said mesh layer.

* * * * *